US011912940B2

(12) United States Patent
Dohi et al.

(10) Patent No.: US 11,912,940 B2
(45) Date of Patent: Feb. 27, 2024

(54) METHOD OF PRODUCING COAL MIXTURE AND METHOD OF PRODUCING COKE

(71) Applicant: JFE Steel Corporation, Tokyo (JP)

(72) Inventors: Yusuke Dohi, Tokyo (JP); Takashi Matsui, Tokyo (JP); Mikiya Nagayama, Tokyo (JP)

(73) Assignee: JFE Steel Corporation, Tokyo (JP)

( * ) Notice: Subject to any disclaimer, the term of this patent is extended or adjusted under 35 U.S.C. 154(b) by 275 days.

(21) Appl. No.: 17/599,110

(22) PCT Filed: Mar. 12, 2020

(86) PCT No.: PCT/JP2020/010679
§ 371 (c)(1),
(2) Date: Sep. 28, 2021

(87) PCT Pub. No.: WO2020/159863
PCT Pub. Date: Oct. 1, 2020

(65) Prior Publication Data

US 2022/0162506 A1 May 26, 2022

(30) Foreign Application Priority Data

Mar. 28, 2019 (JP) ..... 2019-062701

(51) Int. Cl.
*C10B 57/04* (2006.01)
*C10L 5/04* (2006.01)

(52) U.S. Cl.
CPC ..... *C10B 57/04* (2013.01); *C10L 5/04* (2013.01)

(58) Field of Classification Search
CPC ..... C10B 57/04; C10L 5/04
See application file for complete search history.

(56) References Cited

U.S. PATENT DOCUMENTS

| | | | | |
|---|---|---|---|---|
| 2015/0040468 | A1 | 2/2015 | Shimoyama et al. | |
| 2015/0075961 | A1* | 3/2015 | Fukada | C10L 5/04 44/620 |
| 2016/0084816 | A1* | 3/2016 | Sumi | C10B 57/04 366/144 |

FOREIGN PATENT DOCUMENTS

| | | | |
|---|---|---|---|
| CN | 1463247 | A | 12/2003 |
| CN | 1965058 | A | 5/2007 |
| CN | 105958094 | A | 9/2016 |
| DE | 2816891 | A1 | 1/1979 |
| EP | 1 394 110 | A1 | 3/2004 |
| FR | 2 394 598 | A1 | 1/1979 |
| GB | 1 577 212 | A | 5/1978 |
| GB | 1 599 932 | A | 10/1981 |
| GB | 2 357 518 | B | 3/2003 |
| JP | S60-12405 | A | 1/1985 |
| JP | S60-79092 | A | 5/1985 |
| JP | S60-148830 | A | 8/1985 |
| JP | 60-215095 | A | 10/1985 |
| JP | S63-251498 | A | 10/1988 |
| JP | H02-97410 | A | 4/1990 |
| JP | H03-157492 | A | 7/1991 |
| JP | 2002-195966 | A | 7/2002 |
| JP | 2005-281355 | A | 10/2005 |
| JP | 2011-213874 | A | 10/2011 |
| JP | 2016-222767 | A | 12/2016 |
| JP | 2019-112550 | A | 7/2019 |
| RU | 2 467 052 | C1 | 11/2012 |
| RU | 2 604 629 | C2 | 12/2016 |
| RU | 2 613 051 | C1 | 3/2017 |
| WO | 2014/167843 | A1 | 10/2014 |

OTHER PUBLICATIONS

T. Miyazu et al., "The Blending Design Using Many Kinds of Coal and the Evaluation System for Single Coal," Nippon Kokan Technical Report, vol. 67, 1975, pp. 125-137 (Abstract Only).
T. Miyazu et al., "The Blending Design Using Many Kinds of Coal and the Evaluation System for Single Coal," Nippon Kokan Technical Report—Overseas, Dec. 1975 (10 pages).
Y. Miura, "Weathering of Coal During Storage," Process Technology R & D Laboratories, Nippon Steel Corporation, Journal of the Fuel Society of Japan, vol. 58, No. 622, 1979 (Abstract Only).
Office Action dated Oct. 8, 2020, of counterpart Taiwanese Patent Application No. 109109559, along with a Concise Explanation of Relevance in English.
Extended European Search Report dated Apr. 11, 2022, of counterpart European Patent Application No. 20779701.0.
D. Yusuke et al., "Effective Utilization Technique for Coal Having High Maximum Fluidity and Long Maximum Permeation Distance by Weathering Processing," ISIJ International, vol. 59, No. 8, pp. 1457-1464, Aug. 15, 2019, in English.
P.K. Jha et al., "Determination of Weathering Coal Using pH Values of Coal Slurry," International Journal of Coal Preparation Utilization, No. 35, pp. 25-30, Apr. 28, 2014, in English.
Database WPI, (IN 201631028957 A1), in English.
Official Action dated Apr. 29, 2022, of counterpart Russian Patent Application No. 2021128378, along with an English translation.
Examination Report dated May 12, 2022, of counterpart Australian Patent Application No. 2020249743.

(Continued)

*Primary Examiner* — Renee Robinson
(74) *Attorney, Agent, or Firm* — DLA Piper LLP (US)

(57) ABSTRACT

A method of producing a coal mixture includes blending a plurality of coals, wherein formula (1) and formula (2) are satisfied:

$$\alpha_{calc} = \sum_{i}^{N} \alpha_i \times x_i \quad (1)$$

$$\alpha_{calc} \leq 1.2\times10^{-10} \text{ (mol/g-coal)} \quad (2)$$

wherein $\alpha_{calc}$ is a hydrogen ion release capacity per unit mass (mol/g-coal) of the coal mixture, $\alpha_i$ is the hydrogen ion release capacity per unit mass (mol/g-coal) of a coal i, $x_i$ is a blending ratio of the coal i blended in the coal mixture, and N is a total number of brands of coal contained in the coal mixture.

4 Claims, 2 Drawing Sheets

(56) References Cited

OTHER PUBLICATIONS

Office Action dated May 30, 2023, of counterpart Korean Patent Application No. 10-2021-7030965, with a Concise Statement of Relevance of Office Action in English.
Office Action dated Oct. 27, 2023, of counterpart Chinese Patent Application No. 202080024130.2, along with a Concise Explanation of Relevance of Office Action in English.
Guo et al., "Research on the Disassociation Characteristics of Fulvic Acid Extracted from Weathered Coal," China Academic Journal Electronic Publishing House, Humic Acid, No. 4, pp. 15-18, 2003, along with an English translation.
Written Decision on Registration dated Dec. 8, 2023, of counterpart Korean Patent Application No. 10-2021-7030965, along with an English translation.

* cited by examiner

METHOD OF PRODUCING COAL MIXTURE AND METHOD OF PRODUCING COKE

TECHNICAL FIELD

This disclosure relates to a method of producing a coal mixture used to produce coke, and relates to a method of producing a coal mixture in which fluidity can be maintained at a high level for a longer time than in existing techniques and a method of producing coke using the coal mixture.

BACKGROUND

To produce pig iron in a blast furnace, it is necessary that, first, iron ores and coke are alternately charged and packed in layers into the blast furnace, the iron ores and coke are heated by high-temperature hot air blown through tuyeres, and at the same time the iron ore(s) is/are reduced and smelted by CO gas generated mainly from coke. To stably operate such a blast furnace, it is effective to improve permeability of gas and liquid in the furnace. For this purpose, it is essential to use coke being excellent in properties such as strength, particle size, and strength after reaction. Above all, strength is considered to be a particularly important property.

Coke strength is usually controlled by using, as an indicator, for example, a drum strength DI (150/15) measured by the drum strength test specified in JIS K 2151. The coal quality that determines the drum strength includes mainly a coal rank (Ro, JIS M 8816) and fluidity (MF, JIS M 8801) (Takashi Miyazu and 4 others: "Coal blending plan and evaluation of coking coal," Nippon Kokan Technical Report, Vol. 67, 1975, pp. 125-137 and Miyazu, et al., Nippon Kokan Technical Report-overseas, December 1975, p. 1).

Coal fluidity is known to decrease with time because of deterioration due to oxidation in air which is referred to as "weathering." After being mined from a mine, coal is transported and stored repeatedly until it is charged into a coke oven, and coal is usually placed in the air atmosphere for a long time over several weeks or more. Accordingly, it is generally difficult to avoid a decrease in the fluidity of coal due to weathering. Therefore, it has been strongly desired to develop technology to inhibit weathering of coal.

To inhibit weathering of coal, it is effective to reduce contact between coal and oxygen to the smallest possible degree. Japanese Unexamined Patent Application Publication No. 60-12405 discloses a technique in which dry ice is circulated through perforated pipes installed at the bottom of a coal pile to perform replacement with carbon dioxide. Furthermore, Japanese Unexamined Patent Application Publication No. 60-148830 discloses a technique in which inert gas is blown from the bottom. Furthermore, Japanese Unexamined Patent Application Publication No. 3-157492 discloses a technique in which, for the purpose of suppressing diffusion of oxygen from a surface layer to the inside of a coal pile, the surface layer is subjected to coating. In addition, a method of storing coal in water, a method of storing coal in a sealed coal storage tank, a method in which a surface layer of a coal pile is compacted with heavy equipment, and the like are known (Miura, "Weathering of coal and coal storage," Journal of the Fuel Society of Japan, Vol. 58, No. 622, 1979, pp. 112-122).

The techniques disclosed in JP '405 and JP '830 have problems in that it is required to introduce dedicated equipment to blow inert gas including carbon dioxide from the bottom of a coal pile at the place where the coal pile is deposited, and costs are incurred for the gas used. In the ironmaking industry, the amount of coal used and stored in the yard is several hundred thousand tons or more. Consequently, the size of dedicated equipment increases, the cost thereof increases, and operational costs also increase. Therefore, the merit of inhibiting weathering is off-set, and sufficient economic benefits are not obtained. Furthermore, in the technique disclosed in JP '492 in which the surface layer is subjected to coating, there are also problems in that an operation of spraying a coating material is required and the material costs are incurred. In addition, in the method of storing coal in water, the method of storing coal in a sealed coal storage tank, and the method in which a surface layer of a coal pile is compacted with heavy equipment, similarly, there are problems in that capital investment and operational costs are incurred.

It could therefore be helpful to provide a method of producing a coal mixture in which it is possible to suppress a decrease in coal fluidity better than existing techniques by a simple method without excessive capital investment or operational costs.

SUMMARY

We thus provide:

[1] A method of producing a coal mixture including blending a plurality of coals, in which formula (1) and formula (2) are satisfied:

$$\alpha_{calc} = \sum_{i}^{N} \alpha_i \times x_i \tag{1}$$

$$\alpha_{calc} \leq 1.2\times10^{-10} \text{ (mol/g-coal)} \tag{2}$$

wherein $\alpha_{calc}$ is the hydrogen ion release capacity per unit mass (mol/g-coal) of the coal mixture, $\alpha_i$ is the hydrogen ion release capacity per unit mass (mol/g-coal) of a coal i, $x_i$ is the blending ratio of the coal i blended in the coal mixture, and N is the total number of brands of coal contained in the coal mixture.

[2] The method according to [1], in which the hydrogen ion release capacity per unit mass of coal is calculated by dividing the product of hydrogen ion concentration calculated from pH of water in which each of the coals is immersed and the volume of the water in which the coal is immersed by the mass of each of the corresponding coals.

[3] The method according to [1] or [2], in which the coal mixture is produced before being transported into a coke plant equipped with a coke oven.

[4] A method of producing coke including charging the coal mixture produced by the method according to any one of [1] to [3] into a carbonization chamber of a coke oven, and carbonizing the coal mixture to produce coke.

It is thus possible to suppress a decrease in coal fluidity due to weathering by a very simple method of mixing a plurality of coals. Usually, facilities for mixing coals are provided in mines, call centers, loading ports, and coke plants, which handle coal, for the purpose of adjusting the amount and quality of coal products. Since our methods can be carried out using such existing facilities, weathering of coal can be inhibited without additional capital investment for the facilities.

DETAILED DESCRIPTION

We found that the speed of coal weathering varies depending on the pH (i.e., hydrogen ion concentration) of water that adheres to coal and the amount of hydrogen ions that are dis-solved in water varies depending on the types of coal, and thus have considered that by blending different types of coal and adjusting the pH of adhesion water of coal, it is possible to control the speed of coal weathering at a low level. As a result, we found desired conditions in which it is possible to better suppress a decrease in fluidity due to coal weathering by transporting and storing coals as a coal mixture rather than by transporting and storing coals individually.

First, the effect of the pH of treatment water on the speed of coal weathering will be described. Coal was immersed in treatment waters having different pH values, and changes over time in coal fluidity were checked. The pH of treatment waters was adjusted using hydrochloric acid and pure water to a range of pH 2.0 to 5.6. Table 1 shows properties of the coal used.

TABLE 1

| | Ro (%) | logMF (ddpm/log) | TI (%) |
|---|---|---|---|
| Coal A | 0.69 | 0.95 | 54.4 |

Figure 1:
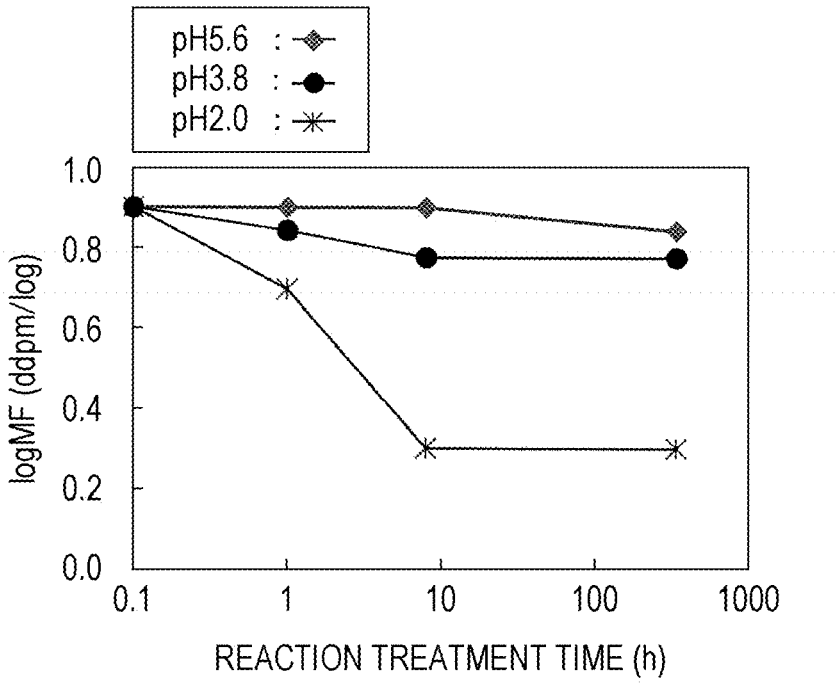
FIG. 1 is a graph showing the relationship between the reaction treatment time and the fluidity of coal.

FIG. 1 is a graph showing the relationship between the reaction treatment time and the fluidity of coal. The horizontal axis of FIG. 1 represents the reaction treatment time (h), and the vertical axis represents the log MF (ddpm/log) of coal. As shown in FIG. 1, we found that as the pH of treatment water decreases, a decrease in coal fluidity becomes faster, and coal weathering proceeds faster. It is known that as the pH decreases, the oxidation-reduction potential increases, and as the oxidation-reduction potential increases, an aqueous solution becomes more oxidizing. From the above result, we found that as coal is treated with an aqueous solution having a lower pH, coal oxidation is promoted, and coal weathering is accelerated.

Next, a description will be made on the pH of water obtained after each of various brands of coal was immersed in a predetermined amount of water, and the hydrogen ion release capacity per unit mass of coal which is defined by the pH. Each of various brands of coal in an amount of 50 g was immersed in 400 ml of pure water, and changes over time in the pH of water heated to 60° C. were measured. The hydrogen ion release capacity is calculated by dividing the product of hydrogen ion concentration calculated from the pH of water and the volume of the water in which the coal is immersed by the mass of the coal immersed. Table 2 shows the hydrogen ion release capacity of each of the brands of coal. When the hydrogen ion release capacity is small, the pH of water in which coal is immersed increases to more than 7 since hydrogen ions are accepted from water.

TABLE 2

| Coal brand | pH (—) | Hydrogen ion release capacity (mol/g-coal) |
|---|---|---|
| Coal B | 3.6 | $1.9 \times 10^{-6}$ |
| Coal C | 7.5 | $2.3 \times 10^{-10}$ |
| Coal D | 6.3 | $4.1 \times 10^{-9}$ |
| Coal E | 8.1 | $6.7 \times 10^{-11}$ |
| Coal F | 8.9 | $1.1 \times 10^{-11}$ |

Figure 2:
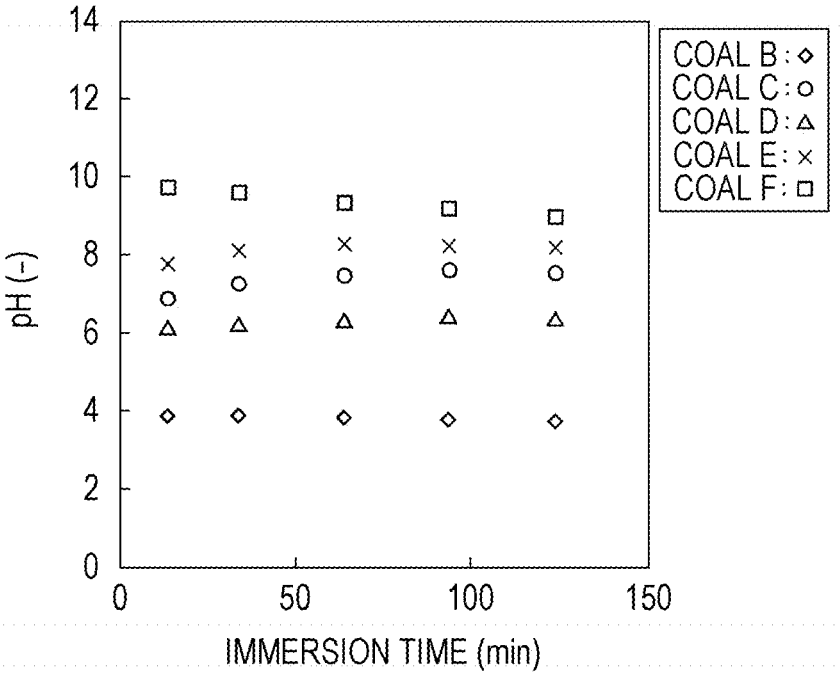
FIG. 2 is a graph showing changes over time in the pH of various brands of coal.

FIG. 2 is a graph showing changes over time in the pH of various brands of coal. The horizontal axis of FIG. 2 represents the immersion time (min), and the vertical axis represents the pH of water in which coal is immersed. As shown in FIG. 2, the pH of water in which coal was immersed varied widely from acidic to basic depending on the brands of coal. There is a possibility that this result may be caused by differences in the amounts of water-soluble sulfate minerals and the types and amounts of organic acids contained in coal. As described above, since the pH of water in which the coal was immersed widely varied depending on the brands of coal, as shown in the results of Table 2, the hydrogen ion release capacity of coal widely varied depending on the brands of coal.

From the results, we found that by blending coals having different hydrogen ion release capacities, the pH of adhesion water adhering to the coals is controlled, and thus weathering of the coal mixture can be inhibited. That is, since the amount of water that adheres to coal (moisture content) during transportation and coal storage is about 10% by mass, reactions by acids and bases take place among coals constituting the coal mixture via 10% by mass of adhesion water, and the reactions influence the speed of coal weathering. We found that by blending a plurality of coals so that the pH of adhesion water increases, it is possible to suppress a decrease in fluidity due to weathering of the coal mixture. Our methods will be described below by way of examples.

In a method of producing a coal mixture in one example, by blending a plurality of coals so that $\alpha_{calc}$ calculated by formula (1) below is $1.2\times10^{-10}$ (mol/g-coal) or less, a coal mixture is produced. That is, a coal mixture that satisfies formula (1) and formula (2) is produced by blending individual brands of coal:

$$\alpha_{calc} = \sum_{i}^{N} \alpha_i \times x_i \tag{1}$$

$$\alpha_{calc} \leq 1.2\times10^{-10} \text{ (mol/g-coal)} \tag{2}$$

In formula (1) and formula (2), $\alpha_{calc}$ is the hydrogen ion release capacity per unit mass (mol/g-coal) of the coal mixture, $\alpha_i$ is the hydrogen ion release capacity per unit mass (mol/g-coal) of a coal i, $x_i$ is the blending ratio of the coal i blended in the coal mixture, and N is the total number of brands of coal contained in the coal mixture.

$\alpha_i$ is the hydrogen ion release capacity per unit mass (mol/g-coal) of a coal i blended in the coal mixture. The hydrogen ion release capacity is calculated by measuring a pH of water in which a candidate coal to be blended in a coal mixture is immersed and dividing the product of hydrogen ion concentration calculated from the pH and the volume of the water in which the coal is immersed by the mass of the coal immersed. When the amount of water in which coal is immersed is too small, the hydrogen ion dissolution reaction does not reach equilibrium, and the hydrogen ion release capacity is calculated to be too low, which is undesirable. When the amount of water in which coal is immersed is too large, a change in hydrogen ion concentration due to immersion of coal is small, and accuracy in measurement of the hydrogen ion release capacity deteriorates, which is undesirable. Therefore, when the pH of water in which coal is immersed is measured, the mass ratio of coal to water (coal:water) is preferably 1:1 or more and 1:100 or less.

As shown in FIG. 2, the pH of water in which coal is immersed slightly changes until the dissolution reaction reaches equilibrium. Accordingly, it is preferable to measure pH after equilibrium is reached. A higher temperature of water in which coal is immersed is preferable. As the temperature of water is increased, the dissolution reaction is promoted, and the time until the dissolution reaction reaches equilibrium is shortened. Thus, pH measurement can be performed quickly. Furthermore, a longer period of time from immersion of coal in water until measuring of pH is preferable.

On the other hand, when the temperature of water in which coal is immersed is too high or the period of time until measuring of pH is too long, coal is weathered, which is undesirable. From these viewpoints, it is preferable to set the temperature of water in which coal is immersed at 0° C. or higher and 80° C. or lower and to set the period of time in which coal is immersed to 1 hour or more and 2 hours or less. As the particle size of coal decreases, the period of time until pH reaches equilibrium decreases, but weathering is likely to proceed more quickly. Therefore, it is not necessary to finely pulverize the coal. Since stirring during immersion of coal can shorten the period of time until pH reaches equilibrium, stirring may be performed. However, without stirring, if coal is immersed for 1 hour or more, pH comes very close to the equilibrium value. Therefore, the coal may be just immersed in water without stirring.

In this way, when a hydrogen ion release capacity of a candidate coal to be blended in a coal mixture can be calculated, a product of the hydrogen ion release capacity of each of coals blended in a coal mixture and the blending ratio is calculated. Types of coal and a blending ratio are determined so that the total sum of the products is $1.2\times10^{-10}$ (mol/g-coal) or less. The blending ratio $x_i$ is calculated by dividing the mass of the coal i blended by the mass of the coal mixture.

For example, when two coals are blended to produce a coal mixture, when one coal has a hydrogen ion release capacity of more than $1.2\times10^{-10}$ (mol/g-coal), a coal having a hydrogen ion release capacity of less than $1.2\times10^{-10}$ (mol/g-coal) is selected as the other coal. The blending ratio of each of the coals is determined so that the total sum of products of the hydrogen ion release capacities and the blending ratios of the coals is $1.2\times10^{-10}$ (mol/g-coal) or less. By determining the types of coal to be blended in a coal mixture and the blending ratio in this way and performing blending, it is possible to produce a coal mixture in which a decrease in fluidity due to weathering is suppressed.

The coals blended may be mixed by a commonly used mixing method. Examples of the coal mixing method include a method in which mixing is performed at a transfer section of a belt conveyor, a method in which mixing is performed in a hopper, a method of mixing using heavy equipment, a method in which dedicated blending equipment such as yard blending or blending bins, is used, and a method of mixing using a mixer. Transport and coal storage may also be performed by commonly used methods. By pulverizing a plurality of types of coal at the same time, pulverization and mixing may be combined.

As described above, the method of producing a coal mixture according to the example can be carried out by only blending a plurality of coals so that $\alpha_{calc}$ calculated by formula (1) described above is $1.2\times10^{-10}$ (mol/g-coal) or less and, therefore, can be carried out by a simple method without excessive capital investment or operational costs. Furthermore, by charging the coal mixture in which a decrease in coal fluidity is suppressed into a carbonization chamber of a coke oven and performing carbonization, coke having high strength can be produced.

As the transportation and coal storage time increases, the degree of decrease in fluidity due to weathering increases. Accordingly, it is preferable to carry out the method of producing a coal mixture according to the example as early as possible after coal is mined, and it is preferable to carry out the method at least before carrying the coal into a coke plant equipped with a coke oven. Thus, the effect of suppressing a decrease in fluidity can be increased.

EXAMPLES

Next, a description will be made on results of evaluation of coal mixtures produced by a method of producing a coal mixture according to the example. Using a thermostat for the purpose of adjusting weathering conditions, changes in fluidity of coal mixtures were checked i when two brands of coal were blended and stored as a coal mixture in the thermostat (before thermostat treatment) and when the same two brands of coal were separately stored in the thermostat and then blended together (after thermostat treatment). The properties, pH, and hydrogen ion release capacity of coal used are shown in Table 3. Coal (50 g) was immersed in 400 ml of pure water maintained at 60° C., and after the coal was immersed for 2 hours in the water, the hydrogen ion release capacity of the coal was calculated from the pH of the water.

TABLE 3

| Coal brand | Ro (%) | logMF (ddpm/log) | TI (%) | pH (—) | Hydrogen ion release capacity (mol/g-coal) |
|---|---|---|---|---|---|
| Coal a | 0.73 | 3.99 | 20.7 | 8.5 | $2.3\times10^{-11}$ |
| Coal b | 0.99 | 1.89 | 35.5 | 8.3 | $3.8\times10^{-11}$ |
| Coal c | 1.00 | 2.83 | 33.3 | 7.6 | $2.0\times10^{-10}$ |
| Coal d | 1.33 | 1.81 | 33.0 | 8.6 | $2.2\times10^{-11}$ |
| Coal e | 0.85 | 3.53 | 18.8 | 3.6 | $2.1\times10^{-6}$ |
| Coal f | 0.86 | 3.49 | 16.8 | 6.9 | $1.0\times10^{-9}$ |
| Coal g | 0.93 | 2.82 | 26.6 | 8.9 | $1.1\times10^{-11}$ |
| Coal h | 0.76 | 2.33 | 21.7 | 7.6 | $1.9\times10^{-10}$ |
| Coal i | 1.06 | 2.48 | 7.6 | 7.6 | $2.3\times10^{-10}$ |

Each of the brands of coal shown in Table 3 was pulverized to a particle size of 9.6 mm or less. Two brands of coal were blended so that the mass ratio on dry basis was 1:1 to produce a coal mixture, and the moisture content was adjusted to 12% by mass. The coal mixture was packed in a closed container, and the closed container was stored in a thermostat kept at 50° C. for 2 weeks. Then, the fluidity of the coal mixture was measured.

On the other hand, each of the same brands of coal as above was pulverized to a particle size of 9.6 mm or less, and the coal whose moisture content was adjusted to 12% by mass was packed in a closed container, and the closed container was stored in a thermostat kept at 50° C. for 2 weeks. Then, two brands of coal after storage were blended so that the mass ratio on dry basis was 1:1 to produce a coal mixture. The fluidity of the coal mixture was measured. The results thereof are shown in Table 4.

TABLE 4

| Level No. | Brand 1 | Brand 2 | Hydrogen ion release capacity (mol/g-coal) | logMF (ddpm/log) Before thermostat treatment | After thermostat treatment | Before treatment − After treatment |
|---|---|---|---|---|---|---|
| 1 | Coal e | Coal c | $1.0 \times 10^{-6}$ | 2.22 | 2.38 | −0.15 |
| 2 | Coal e | Coal h | $1.0 \times 10^{-6}$ | 2.04 | 2.31 | −0.27 |
| 3 | Coal f | Coal c | $6.0 \times 10^{-10}$ | 2.76 | 3.05 | −0.28 |
| 4 | Coal f | Coal h | $6.0 \times 10^{-10}$ | 2.81 | 2.90 | −0.09 |
| 5 | Coal c | Coal h | $1.9 \times 10^{-10}$ | 2.20 | 2.37 | −0.17 |
| 6 | Coal a | Coal h | $1.1 \times 10^{-10}$ | 3.23 | 3.10 | 0.13 |
| 7 | Coal d | Coal i | $1.2 \times 10^{-10}$ | 1.67 | 1.66 | 0.01 |
| 8 | Coal d | Coal a | $2.3 \times 10^{-11}$ | 2.56 | 2.45 | 0.11 |
| 9 | Coal d | Coal g | $1.6 \times 10^{-11}$ | 1.88 | 1.72 | 0.16 |
| 10 | Coal e | Coal i | $1.0 \times 10^{-6}$ | 2.23 | 2.23 | 0.01 |
| 11 | Coal e | Coal a | $1.0 \times 10^{-6}$ | 2.98 | 3.09 | −0.11 |
| 12 | Coal e | Coal g | $1.0 \times 10^{-6}$ | 2.43 | 2.57 | −0.14 |
| 13 | Coal e | Coal d | $1.0 \times 10^{-6}$ | 1.28 | 1.26 | 0.02 |
| 14 | Coal f | Coal d | $5.1 \times 10^{-10}$ | 1.98 | 1.99 | −0.01 |
| 15 | Coal g | Coal i | $1.2 \times 10^{-10}$ | 2.24 | 2.20 | 0.04 |
| 16 | Coal c | Coal a | $1.1 \times 10^{-10}$ | 3.00 | 2.92 | 0.09 |
| 17 | Coal g | Coal c | $1.1 \times 10^{-10}$ | 1.81 | 1.72 | 0.09 |
| 18 | Coal d | Coal c | $1.1 \times 10^{-10}$ | 1.04 | 0.95 | 0.09 |
| 19 | Coal d | Coal h | $1.0 \times 10^{-10}$ | 0.78 | 0.40 | 0.38 |
| 20 | Coal c | Coal h | $1.9 \times 10^{-10}$ | 1.08 | 1.00 | 0.08 |
| 21 | Coal g | Coal h | $9.9 \times 10^{-11}$ | 1.18 | 0.95 | 0.22 |

The value under the column "Hydrogen ion release capacity" of Table 4 is the hydrogen ion release capacity per unit mass of the coal mixture ($\alpha_{calc}$) calculated using formula (1) described above. For example, in Level No. 1 of Table 4, the calculation was made by [hydrogen ion release capacity of Coal e ($2.1\times10^{-6}$)×blending ratio (0.5)]+[hydrogen ion release capacity of Coal c ($2.0\times10^{-10}$)×blending ratio (0.5)].

The value under the column "Before thermostat treatment" is the measured value of fluidity of the coal mixture which was produced by blending two brands of coal before storage in the thermostat and then storing in the thermostat. The value under the column "After thermostat treatment" is the measured value of fluidity of the coal mixture which was produced by storing the same two brands of coal as above separately in the thermostat and blending the coals after storing. The value under the column "Before treatment—After treatment" is the difference between the measured value "before thermostat treatment" and the measured value "after thermostat treatment."

Figure 3:
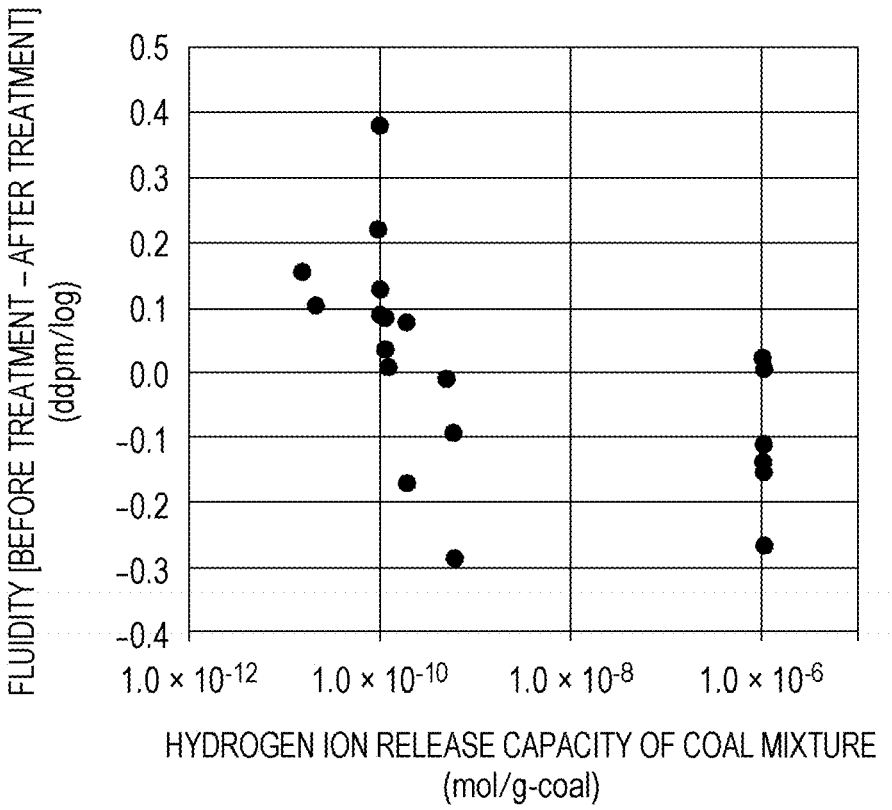
FIG. 3 is a graph showing the relationship between the hydrogen ion release capacity of coal mixture and the fluidity "before treatment—after treatment."

FIG. 3 is a graph showing the relationship between the hydrogen ion release capacity of coal mixture and the fluidity "before treatment—after treatment." The horizontal axis of FIG. 3 represents the hydrogen ion release capacity of coal mixture (mol/g-coal), and the vertical axis represents the fluidity "before treatment—after treatment" (ddpm/log). A positive value of fluidity "before treatment—after treatment" indicates that a decrease in fluidity is small when coals are stored as a coal mixture in the thermostat compared to when coals are stored separately as individual coals in the thermostat. On the other hand, a negative value of fluidity "before treatment—after treatment" indicates that a decrease in fluidity is large when coals are stored as a coal mixture in the thermostat compared to when coals are stored separately as individual coals in the thermostat.

As shown in FIG. 3, as the hydrogen ion release capacity of coal mixture decreased, the value of fluidity "before treatment—after treatment" tended to be positive. In particular, in all of coal mixtures with a hydrogen ion release capacity of $1.2\times10^{-10}$ or less, the fluidity "before treatment—after treatment" was positive. A coal mixture in which a decrease in fluidity was small was obtained when coals were stored as a coal mixture in the thermostat compared to when coals were stored separately as individual coals in the thermostat. The results confirmed that when a coal mixture is produced so that the hydrogen ion release capacity thereof is $1.2\times10^{-10}$ or less, it is possible to suppress a decrease in fluidity compared to the individual coals to be blended in the coal mixture. In particular, when the hydrogen ion release capacity was $1.0\times10^{-10}$ or less, the fluidity "before treatment—after treatment" value was more than 0.1. The result shows that it is more preferable to produce a coal mixture so that the hydrogen ion release capacity thereof is $1.0\times10^{-10}$ or less.

The invention claimed is:

1. A method of producing a coal mixture comprising blending a plurality of coals, wherein formula (1) and formula (2) are satisfied:

$$\alpha_{calc} = \sum_{i}^{N} \alpha_i \times x_i \tag{1}$$

$$\alpha_{calc} \leq 1.2\times10^{-10} \text{ (mol/g-coal)} \tag{2}$$

wherein $\alpha_{calc}$ is a hydrogen ion release capacity per unit mass (mol/g-coal) of the coal mixture, $\alpha_i$ is the hydrogen ion release capacity per unit mass (mol/g-coal) of a coal i, $x_i$ is a blending ratio of the coal i blended in the coal mixture, and N is a total number of brands of coal contained in the coal mixture, wherein the hydrogen ion release capacity per unit mass of coal is calculated by dividing a product of hydrogen ion concentration calculated from pH of water in which each of the coals is immersed and the volume of the water in which the coal is immersed by the mass of each of the corresponding coals, and when the pH of the water in which the coals are immersed is measured, the mass ratio of coal to water (coal:water) is 1:1 or more and 1:100 or less, the temperature of the water in which the coals are immersed is 0° C. or higher and 80° C. or lower, and a period of time in which the coals are immersed is 1 hour or more and 2 hours or less.

2. The method according to claim 1, wherein the coal mixture is produced before being transported into a coke plant equipped with a coke oven.

3. A method of producing coke comprising:

charging the coal mixture produced by the method according to claim 2 into a carbonization chamber of a coke oven; and carbonizing the coal mixture to produce coke.

4. A method of producing coke comprising:

charging a coal mixture produced by the method according to claim 1 into a carbonization chamber of a coke oven; and carbonizing the coal mixture to produce coke.

* * * * *